US011566400B2

(12) United States Patent
Schwall

(10) Patent No.: US 11,566,400 B2
(45) Date of Patent: Jan. 31, 2023

(54) ELECTRICALLY POWERED HYDRAULIC SYSTEM AND A METHOD FOR CONTROLLING AN ELECTRICALLY POWERED HYDRAULIC SYSTEM

(71) Applicant: Volvo Construction Equipment AB, Eskilstuna (SE)

(72) Inventor: Michael Schwall, Salmtal (DE)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 16/966,499

(22) PCT Filed: Mar. 19, 2018

(86) PCT No.: PCT/EP2018/056872
§ 371 (c)(1),
(2) Date: Jul. 31, 2020

(87) PCT Pub. No.: WO2019/179596
PCT Pub. Date: Sep. 26, 2019

(65) Prior Publication Data
US 2021/0054599 A1 Feb. 25, 2021

(51) Int. Cl.
*E02F 9/22* (2006.01)

(52) U.S. Cl.
CPC ..... *E02F 9/2246* (2013.01); *E02F 9/2203* (2013.01); *E02F 9/2278* (2013.01)

(58) Field of Classification Search
CPC ..... E02F 9/207; E02F 9/2221; E02F 9/2246; F15B 2211/20515; F15B 2211/20538; F15B 2211/40
See application file for complete search history.

(56) References Cited

U.S. PATENT DOCUMENTS 4,635,439 A * 1/1987 Wible ..... B62D 5/07 60/420
6,078,855 A * 6/2000 Kinugawa ..... E02F 9/22 701/50

(Continued)

FOREIGN PATENT DOCUMENTS

CN 102296661 A 12/2011
EP 0407231 A1 1/1991

(Continued)

OTHER PUBLICATIONS

International Search Report and Written Opinion of the International Searching Authority, PCT/EP2018/056872, dated Nov. 30, 2018, 10 pages.

(Continued)

*Primary Examiner* — Michael Leslie
*Assistant Examiner* — Matthew Wiblin
(74) *Attorney, Agent, or Firm* — Sage Patent Group

(57) ABSTRACT

An electrically powered hydraulic system for a working machine includes: an electric motor to power a working hydraulic pump. A flow of hydraulic fluid generated by the hydraulic pump is controlled by the operation rotational speed of the electric motor. An electronic control unit is configured to: when an operator input device is in a first operating range, maintain the electric motor at a constant rotational speed, and control a variation in flow of hydraulic fluid to the hydraulic function with an electronically controlled control valve, and when the operator input device is in a second operating range, control a variation in flow of hydraulic fluid by varying the electric motor rotational speed and by controlling the control valve, according to displacement of the operator input device.

11 Claims, 5 Drawing Sheets

(56) References Cited

U.S. PATENT DOCUMENTS

| | | | | |
|---|---|---|---|---|
| 6,463,949 | B2 * | 10/2002 | Ferguson | F04B 49/065 137/2 |
| 6,851,207 | B2 * | 2/2005 | Yoshimatsu | E02F 9/2075 37/348 |
| 2019/0145433 | A1 * | 5/2019 | Thompson | E02F 9/2292 60/422 |

FOREIGN PATENT DOCUMENTS

| | | | |
|---|---|---|---|
| EP | 0866177 | A2 | 9/1998 |
| EP | 1291467 | A | 3/2003 |
| EP | 2287406 | A1 | 2/2011 |
| EP | 2677180 | A | 12/2013 |
| JP | 2002105985 | A | 4/2002 |

OTHER PUBLICATIONS

Chinese First Office Action dated Dec. 3, 2021 for Chinese Patent Application No. 201880089182.0, 16 pages (including English translation).

* cited by examiner

ELECTRICALLY POWERED HYDRAULIC SYSTEM AND A METHOD FOR CONTROLLING AN ELECTRICALLY POWERED HYDRAULIC SYSTEM

CROSS REFERENCE TO RELATED APPLICATIONS

This application is a 35 U.S.C. § 371 national stage application of PCT International Application No. PCT/EP2018/056872 filed on Mar. 19, 2018, the disclosure and content of which is incorporated by reference herein in its entirety.

TECHNICAL FIELD

The invention relates to an electrically powered hydraulic system and to a method for controlling an electrically powered hydraulic system.

The invention is applicable on working machines within the fields of industrial construction machines or construction equipment, in particular wheel loaders. Although the invention will be described with respect to a wheel loader, the invention is not restricted to this particular machine, but may also be used in other working machines such as articulated haulers, excavators and backhoe loaders.

BACKGROUND

An operator of a working machine such as a wheel loader may control the operation of hydraulic functions by displacing e.g. a joystick. The degree of displacement may be related to the operation speed of the hydraulic function. In order to provide different operation speeds, the hydraulic pressure provided by the hydraulics of the wheel loader is typically varied. For instance, a higher pressure may enable a higher operation speed.

EP2677180 describes an example hydraulic drive system for a working machine. The hydraulic drive system described in EP2677180 may perform normal operation and precision operation. The precision operation is performed at a smaller manipulation stroke than the normal operation. The hydraulic drive system disclosed by EP2677180 is provided with a variable displacement hydraulic pump to provide pressurized oil to a working element.

However, working machines such as wheel loaders generally generate relatively high intensities of noise during operation. The noise may be caused by the engines providing propulsion of the wheel loader but also by electric machines controlling the hydraulics system of the wheel loader. The hydraulic system may for example be arranged to control hydraulic functions such as movements of a boom or bucket attached to the wheel loader, a steering hydraulics, or other auxiliary functions.

The noise levels may cause an unsuitable working environment for the crew at the same site as the working machine as well as for the operator of the working machine.

Accordingly, there is a need for less noisy control of hydraulic functions for working machines.

SUMMARY

An object of the invention is to provide an electrically powered hydraulic system with improved noise characteristics to thereby alleviate the above mentions problems with prior art.

According to a first aspect of the invention, the object is achieved by a system according to claim 1.

According to the first aspect of the invention, there is provided an electrically powered hydraulic system for a working machine, the electrically powered hydraulic system comprises: an electric motor to power a working hydraulic pump to operate at least one hydraulic function of the working machine, wherein a flow of hydraulic fluid generated by the hydraulic pump is controlled by the operation speed of the electric motor, an electronically controlled control valve for controlling the flow of hydraulic fluid from the pump to the at least one hydraulic function, an operator input device for controlling the at least one hydraulic function, wherein the operator input device is operable in at least two operating ranges, and an electronic control unit configured to: when the operator input device is in a first operating range, maintain the electric motor at a constant rotational speed, and control a variation in flow of hydraulic fluid to the hydraulic function with the control valve, and when the operator input device is in a second operating range, control a variation in flow of hydraulic fluid by varying the electric motor rotational speed and by controlling the control valve, according to displacement of the operator input device.

The present invention is based on the realization that the disturbing noise variations from an electric motor may be reduced by maintaining the electric motor powering the working hydraulic pump at a constant speed. Moreover, it was realized that the operating range for the input device may be divided in several operating ranges, and that the electric motor providing power to the hydraulic pump may be kept at a constant speed in at least one operating range without compromising the functionality of the hydraulic function.

By the provision of a system which comprises an electric motor which is maintained at a constant speed by a control unit when the operator input device is in a first operating range, the advantage of reduced noise variations from the electric motor is provided. Further, in some working conditions, when the operator input device is in a second operating range, the electric motor may vary its rotational speed to provide additional power to the working hydraulic pump only when it is needed. Thereby the overall functionality of the hydraulic system is not compromised.

Moreover, according to the inventive concept, two different control principles for the hydraulic function are advantageously included. The overall generated hydraulic fluid flow by the working hydraulic pump is electronically controlled through the operation speed of the electric motor. The hydraulic fluid flow to the individual hydraulic cylinders for the hydraulic functions may be controlled through an electronically controlled control valve. This so called electro-hydraulic system may be controlled by the electronic control unit.

The operator input device is operable in each of the operating ranges, but may also be operable between the operating ranges, i.e. the operator input device may be transitioned between the ranges by e.g. operator input.

According to one embodiment, the electric motor rotational speed may be higher when the operator input device is in the second operating range, than the constant operation rotational speed of the electric motor when the operator input device is in a first operating range. Hereby, the electric motor may advantageously cause the hydraulic pump to provide higher pressure to the hydraulic function when the operator input device is in the second operating function compared to in the first operating range. Thereby, fast operation of the hydraulic function is enabled when the operating input device is in the second operating range.

In one embodiment, the operator input device is configured to control the operation speed of a wheel loader attachment, or a wheel loader boom. Accordingly, the inventive concept is advantageously applicable to commonly used hydraulic functions for a wheel loader.

According to a further embodiment, the electric motor is a first electric motor, the system further comprising a second electric motor to power the drivetrain of the working machine.

Thus, the overall noise from the working machine comprising such the electrically powered hydraulic system is advantageously further reduced by using an electric motor also for providing propulsion.

In addition, there may be a third electric motor for further auxiliary functions, such as for steering.

There is further provided a wheel loader comprising the electrically powered hydraulic system according to the first aspect or embodiments thereof.

According to a second object, there is provided method for controlling an electrically powered hydraulic system for a working machine, the system comprising an electric motor to power a working hydraulic pump to operate at least one hydraulic function of the working machine, wherein a flow of hydraulic flow generated by the hydraulic pump is controlled by the operation speed of the electric motor, and an electronically controlled control valve for controlling the flow of hydraulic fluid from the pump to the at least one hydraulic function, the method is comprising the steps: receiving an input signal from an operator input device to control a speed of a hydraulic function of the working machine, determining that the input signal is related to one of at least two operating ranges of the operator input device, wherein, when the operator input device is determined to be in a first operating range, maintaining the electric motor at a constant rotational speed, and controlling a variation in flow of hydraulic fluid to the hydraulic function with the control valve, and when the operator input device is determined to be in a second operating range, varying the electric motor rotational speed according to input device displacement to thereby, in combination with the control valve control the variation in flow of hydraulic fluid.

According to an embodiment, when the operator input device is determined to be in the second operating range, varying the electric motor rotational speed proportional to input device displacement. Thus, if the operator requests fast operation of the hydraulic function, displacement control of the hydraulic system is used where the electric motor speed will be increased proportionally with the displacement to provide the requested hydraulic fluid flow. Thus, the hydraulic system may provide accelerated operation of the hydraulic function, and operation of the hydraulic function at varying operation speeds, if requested by the operator.

Effects and features of the second aspect of the invention are largely analogous to those described above in connection with the first aspect.

There is further provided a computer program comprising program code means for performing the steps of the method according to the second aspect when said program is run on a computer.

There is further provided a computer readable medium carrying a computer program comprising program code means for performing the steps of the method according to the second aspect when said program product is run on a computer.

There is further provided a control unit for controlling an electrically powered hydraulic system for a working machine, the control unit being configured to perform the steps of the method according to the second aspect.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
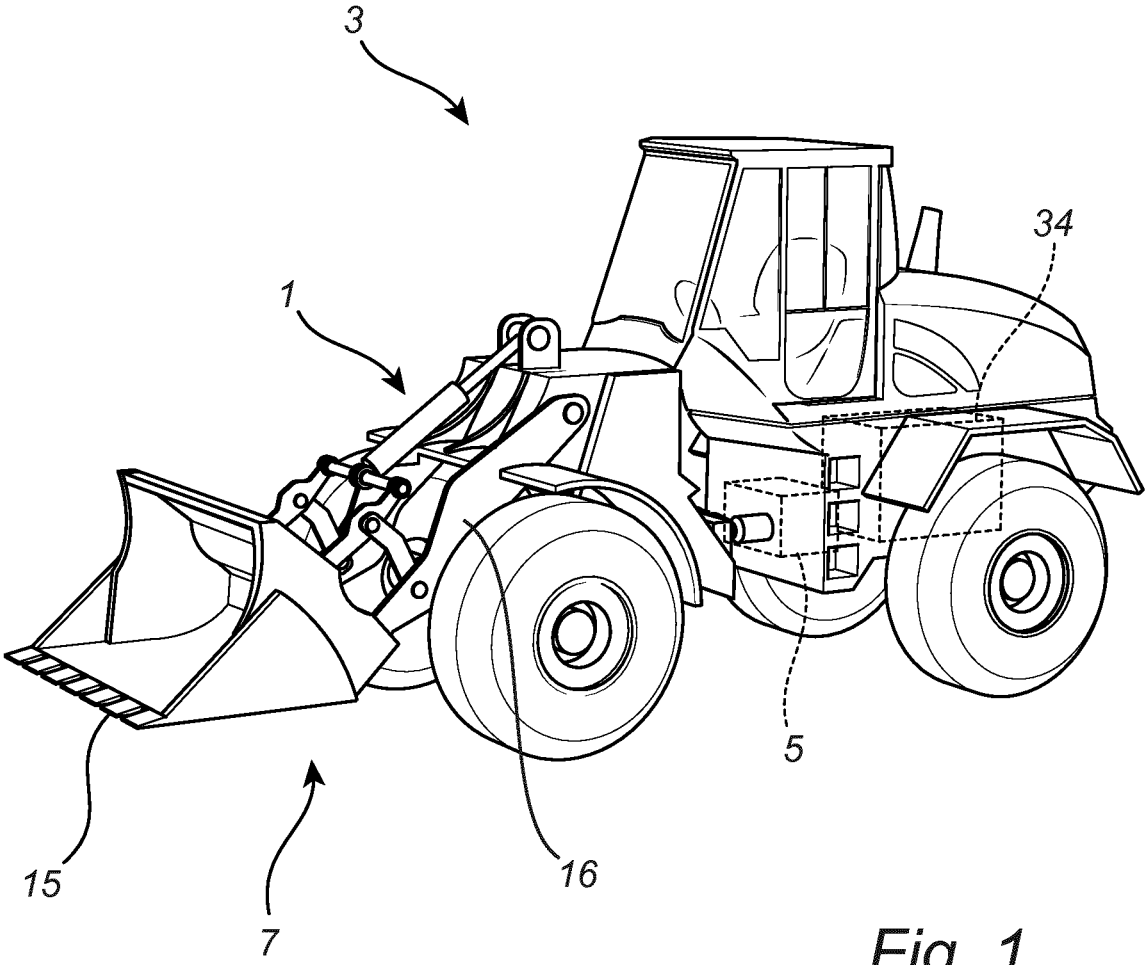
FIG. 1 illustrates an example working machine in the form of a wheel loader.

It is to be understood that the present invention is not limited to the embodiments described above and illustrated in the drawings; rather, the skilled person will recognize that many changes and modifications may be made within the scope of the appended claims.

FIG. 1 illustrates a working machine in the form of a wheel loader 3. The wheel loader 3 comprises an electrically powered hydraulic system 1 for controlling at least one hydraulic function. The hydraulic function may relate to controlling the operation speed of a wheel loader attachment such as a bucket 15, or the operation speed of the boom 16. The electrically powered hydraulic system 1 of the wheel loader 3 comprises an electric motor 5 for powering a working hydraulic pump (not shown). The wheel loader 3 may optionally further comprise another electric motor 34 for providing propulsion for the wheel loader 3. Thus, the wheel loader 3 may be an all electric wheel loader 3 particularly suitable for indoor operation.

Figure 2:
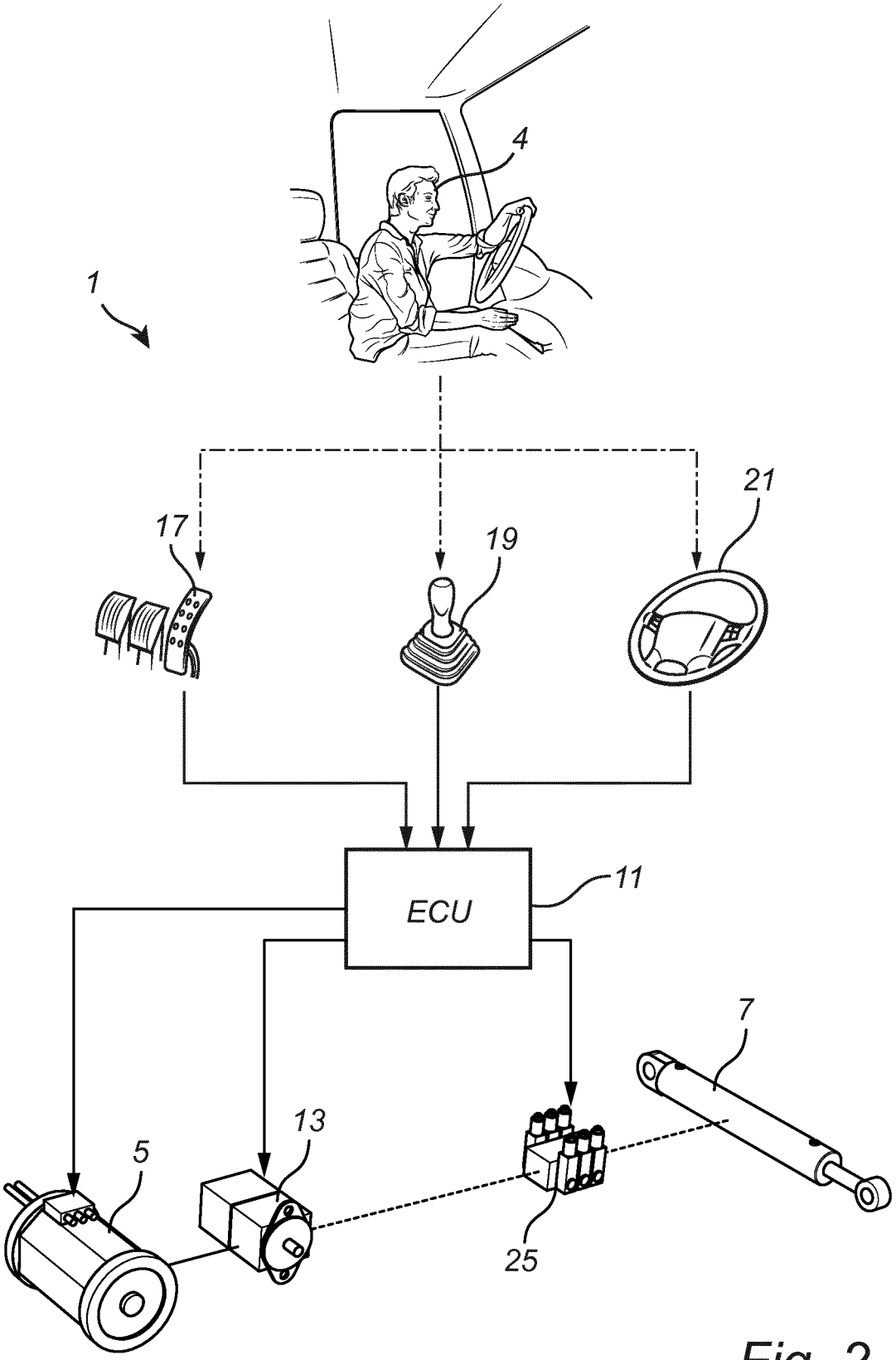
FIG. 2 is an overview of an example electrically powered hydraulic system.

FIG. 2 is an overview of the electrically powered hydraulic system 1. The system comprises an operator input device which may be in the form of a joystick 19 which allows the operator 4 to control the operation of a hydraulic function 7 via input commands using the joystick 19. Further possible operator input devices may be a drive pedal 17, and a steering wheel 21.

An electric control unit 11 is configured to receive input signals form the input device 19 (or 17, 21), and to interpret the input signals and control the hydraulic function 7 by varying a flow of hydraulic fluid to the hydraulic function 7. For controlling the hydraulic function, the electric control unit 11 is configured to control the operation speed of an electric motor 5 which is arranged to power a working hydraulic pump 13. The working hydraulic pump 13 is arranged to provide a flow of hydraulic fluid (indicated by a dashed line) to an electronically controlled control valve 25.

The electronically controlled control valve 25 is configured to distribute the hydraulic fluid (indicated by a dashed line) to the hydraulic functions 7 according to instructions provided from the electric control unit 11. For instance, the operator input signals received by the electric control unit 11 may indicate that a first hydraulic function and a second hydraulic function desirable to operate. The electric control unit 11 provides instruction to the electronically controlled control valve 25 to open the respective valve of the electronically controlled control valve 25 to the first and second hydraulic functions according to the user input signals. Thus the electronically controlled control valve 25 may comprise several valves as will be described in more detail with reference to FIG. 4. Generally, the electronically controlled control valve 25 is a main control valve (MCV) comprising distinguished valves which may be displaced in order to allow flow of hydraulic fluid to pass through the valve to a respective hydraulic function.

The electronic control unit 11 is configured to determine which of at least two operating ranges the operator user input device is presently in. When the operator input device 19 is in a first operating range, the electronic control unit 11 controls the electric motor 5 to maintain at a constant rotational speed. If a variation in flow to the hydraulic function 7 is requested from a user input signal in the first range, i.e. by displacement of the input device 19 within the first range, then the variation in flow of hydraulic fluid to the hydraulic function is controlled with the electronically controlled control valve 25. Moreover, when the operator input device is in a second operating range, the electronic control unit 11 control a variation in flow of hydraulic fluid by varying the electric motor rotational speed and by controlling the control valve, according to displacement of the operator input device 19.

Figure 3A:
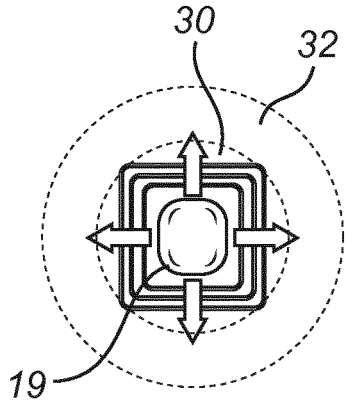
FIG. 3*a* schematically illustrates an operator input device and corresponding operating ranges.

FIG. 3*a* conceptually illustrates an operator input device 19 and corresponding operating ranges 30 and 32. The user input device 19 (e.g. a joystick) is here shown centred in the first operating range 30. Thus, if the user input device 19 is displaced, it will initiate its displacement in the first operating range 30. The user input device 19 may be displaced in any direction indicated by the arrows, or combinations thereof. The further the input user device 19 is displaced from the illustrated centre position, the faster operation speed of the hydraulic function is desired by the operator. Accordingly, the further the operator input device 19 is displaced from the illustrated centre position, the higher flow of hydraulic fluid is required to the provided to the hydraulic function.

Figure 3B:
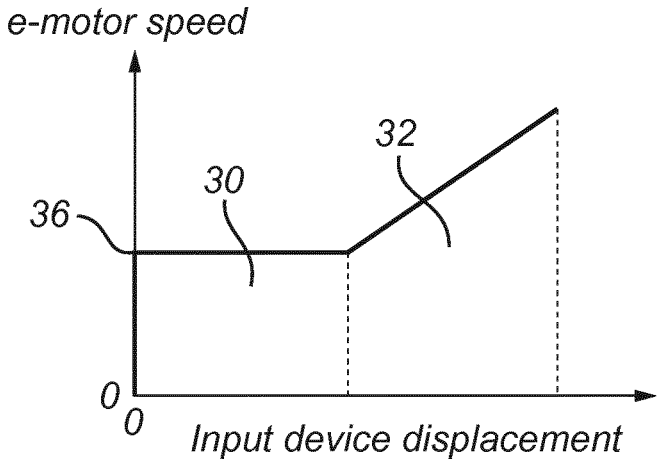
FIG. 3*b* shows a graph that schematically shows electric motor speed versus operator input device displacement.

FIG. 3*b* is a graph that schematically shows electric motor speed versus operator input device 19 displacement. At zero displacement is the operator input device 19 at its centre position, i.e. as shown in FIG. 3*a*. When the operator input device 19 is displaced away from its centre position, i.e. away from displacement equal to zero (or at least nearly equal to zero), the operator input device 19 is displaced in the first operating range 30. In the first operating range 30 is the electric motor speed maintained at a constant speed 36. When the operator input device 19 is displaced further and into the second operating range 32, then the electric motor speed is increased proportionally with the operator input device 19 displacement.

Figure 3C:
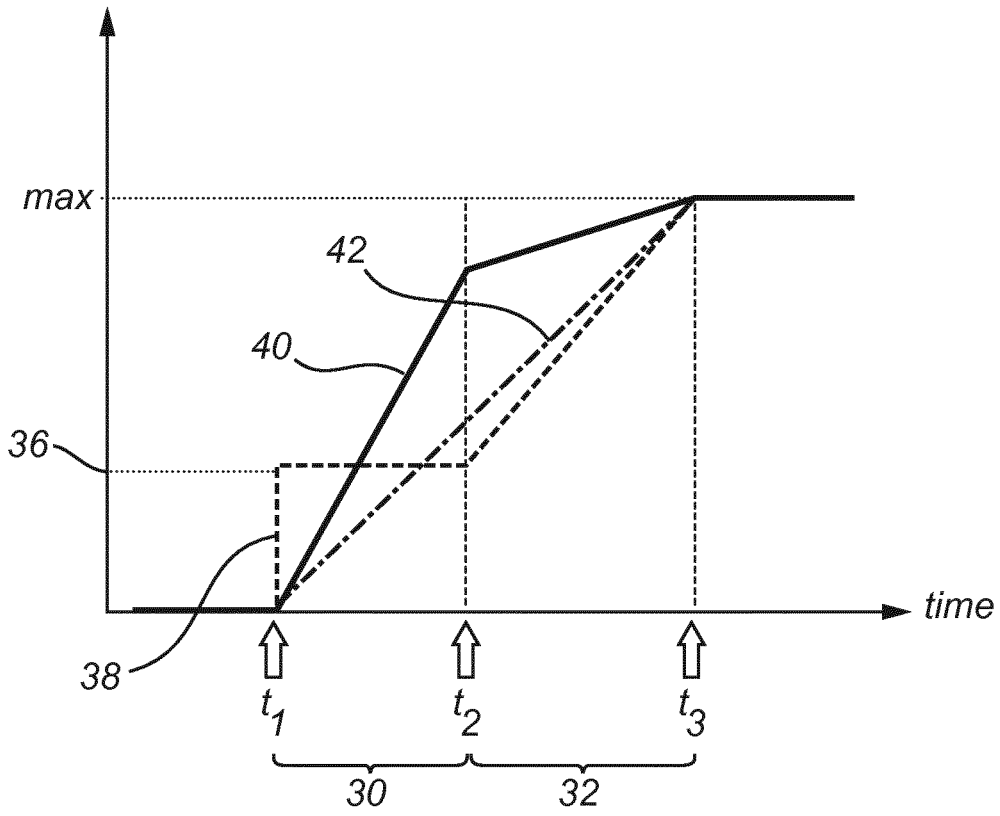
FIG. 3*c* is a graph representation of electric motor speed, control valve displacement, and operator input device displacement versus time.

FIG. 3*c* is a graph that schematically shows electric motor speed versus time (line 38), control valve displacement versus time (line 40) for one hydraulic function, and operator input device displacement versus time (line 42), on a common y-axis. Up to time t1 the user input device has not been displaced and there electric motor speed and the control valve displacement are therefore at or close to zero.

At time $t_1$, the operator input device is starting to displace within the first operating range (see also FIGS. 3*a-b*). Thus the electronic control unit controls the electric motor to operate at a constant operating speed 36 (see also FIG. 3*b*). In the first operating range, the electric motor operates at a speed sufficient to power the hydraulic pump to provide high enough hydraulic fluid flow to the electrically controlled valve to provide all the hydraulic functions with sufficient flow consistent with the first operating range of the operator input device. In other words, the electrically controlled control valve is provided with high enough hydraulic fluid flow to operate all the hydraulic functions connected to the electrically controlled control valve with the highest flow within the first operating range of the operator input device.

In the example graph shown in FIG. 3*c*, the operator input device is continuously displaced until time $t_2$. In this time range, ($t_1$ to $t_2$), the operator input device is in the first operating range 30. The displacement of the electronically controlled control valve is increased as the operator input device is further displaced, thus requesting higher flow of hydraulic fluid to the hydraulic functions. This is understood from the linear increase in the curve 40 representing the control valve displacement versus time at the same time as the increase in curve 42 representing operator input device displacement versus time.

At time $t_2$, the operator input device is displaced into the second operating range 32. Thus, the requested operating speed for the hydraulic function now requires a relatively high flow of hydraulic fluid. Therefore, the electric motor speed also increases as seen in the curve 38 after time $t_2$ in order to provide high enough power to the hydraulic pump so that the hydraulic pump can provide sufficient flow of hydraulic fluid flow to the electrically controlled control valve. Additionally, the displacement of the electronically controlled control valve is also affected by the higher fluid flow from the hydraulic pump. After time $t_2$, the displacement of the electronically controlled control valve does not have to increase at the same rate, in this example. At time $t_3$, the operator input device is displaced to a maximum displacement whereby the electric motor is at maximum speed and the electronically controlled control valve is displaced to a maximum displacement.

The operator requests an operating speed of a hydraulic function by displacing the input device 19. The electric control unit 11 is configured to calculate the hydraulic fluid flow required to satisfy the request by the operator. The electric motor is configured to operate at a speed to be able to supply hydraulic fluid to all functions requiring hydraulic fluid flow given the request by the operator. The electrically controlled control valve 25 distributes the hydraulic fluid flow to the hydraulic functions according to the request from the operator.

Figure 4:
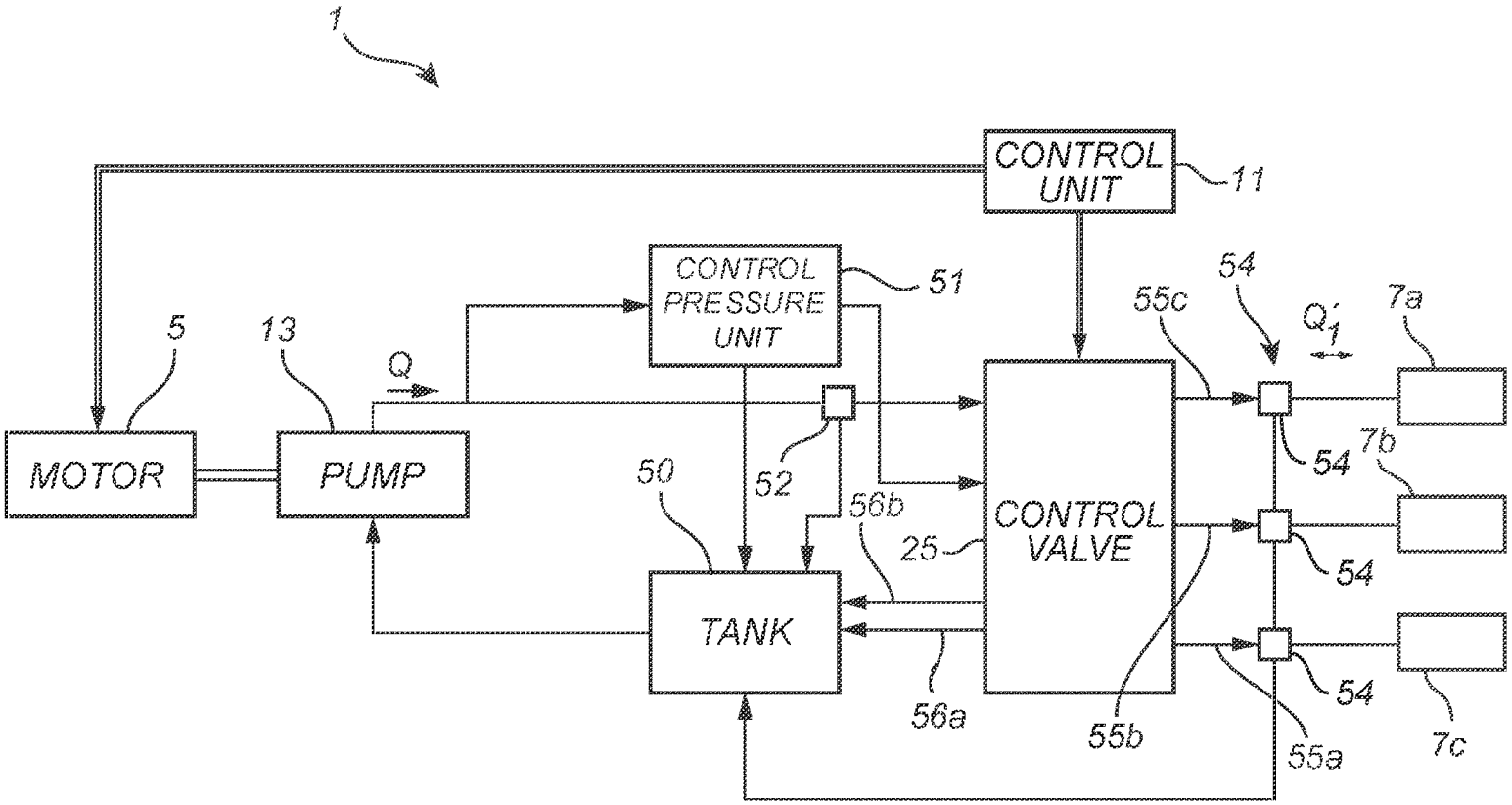
FIG. 4 illustrates an example embodiment of an electrically powered hydraulic system 1.

FIG. 4 illustrates an example embodiment of an electrically powered hydraulic system 1. The system comprises an electric motor 5 to power a working hydraulic pump 13. The working hydraulic pump 13 receives hydraulic fluid from a tank 50. The electric motor 5 operates at a speed n. The working hydraulic pump 13 provides a hydraulic fluid flow Q to the system 1 which may be given by $Q=V_g*n$, where $V_g$ is the hydraulic fluid flow as received from the tank 50. The total fluid flow Q provided to the hydraulic system 1 is limited by the maximum operating speed of the electric motor 5, i.e. $Q_{max}=V_g*n_{max}$.

The electrically powered hydraulic system 1 further comprises a control pressure unit 51 configured to provide a hydraulic fluid pressure to the electrically controlled control valve (i.e. the main control valve) in order to displace the individual valves in the electrically controlled control valve 25. An electric signal (indicated by double line) from the control unit 11 controls the hydraulic fluid pressure for displacing the respective valve in the electrically controlled control valve 25. There is further a primary shut off valve 52 connected to the hydraulic fluid line between the working hydraulic pump 13 and the electrically controlled control valve 25. The primary shut off valve 52 is configured to redirect overpressure hydraulic fluid from the primary shut off valve 52 back to the tank 50. Return line 56*a* is configured to return the hydraulic fluid used for controlling the displacement of the valves in the electrically controlled control valve 25 back to the tank 50.

The electrically controlled control valve 25 receives the hydraulic fluid flow Q from the working hydraulic pump 13. The electrically controlled control valve 25 further receives control signals (indicated by double line) from an electronic control unit 11 indicative of the position or displacement of an operator input device (not shown in FIG. 5). The electrically controlled control valve 25 is a parallel hydraulic circuit and thus distributes the hydraulic fluid flow Q to multiple hydraulic functions 7*a*, 7*b*, and 7*c*. The total hydraulic fluid flow to the hydraulic functions 7*a-c* is given by Q'=displacement*Q, where displacement is the displacement of the operator input device in relative terms, e.g., as a percentage of maximum displacement, or a ratio between present displacement and maximum displacement. Secondary shut off units 54 arranged in the hydraulic fluid flow lines 55*a-c* between the hydraulic functions 7*a-c* and the electrically controlled control valve 25 are configured to provide overpressure hydraulic fluid back to the tank 50. Return line 56*b* is configured to return the overpressure hydraulic fluid not used by the electrically controlled control valve 25 back to the tank 50.

The electric motor 5 receives a control signal from the electronic control unit 11. If the operator input device is in the first operating range, then the electronic control unit 11 controls the electric motor 5 to operate at a constant operating speed. A variation of hydraulic fluid flow is then controlled by the electrically controlled control valve 25 according to operator input device as described above. Thus, the electric motor operates at a fixed speed and the hydraulic fluid flow to the cylinders of the hydraulic functions is regulated by the displacement of the individual valves in the electrically controlled control valve 25. If the operator input device is in the second operating range, then the electronic control unit 11 controls the electric motor 5 to operate at an operating speed that depends on the operator input device displacement as described with reference to e.g. FIGS. 3*a-c*. Furthermore, the electrically controlled control valve 25 may still vary the hydraulic fluid flow to the hydraulic functions 7*a-c*, but when the operator input device is in the second operating range then a variation in the hydraulic fluid flow to the hydraulic functions 7*a-c* is controlled cooperatively between the electrically controlled control valve 25 and the electric motor 5 speed variation. Accordingly, If the operator requests fast movements of the hydraulic functions (i.e. in the second operating range), the hydraulic control passes over to a displacement control where the electric motor operation speed will be increased additionally to provide the requested hydraulic fluid flow.

Figure 5:
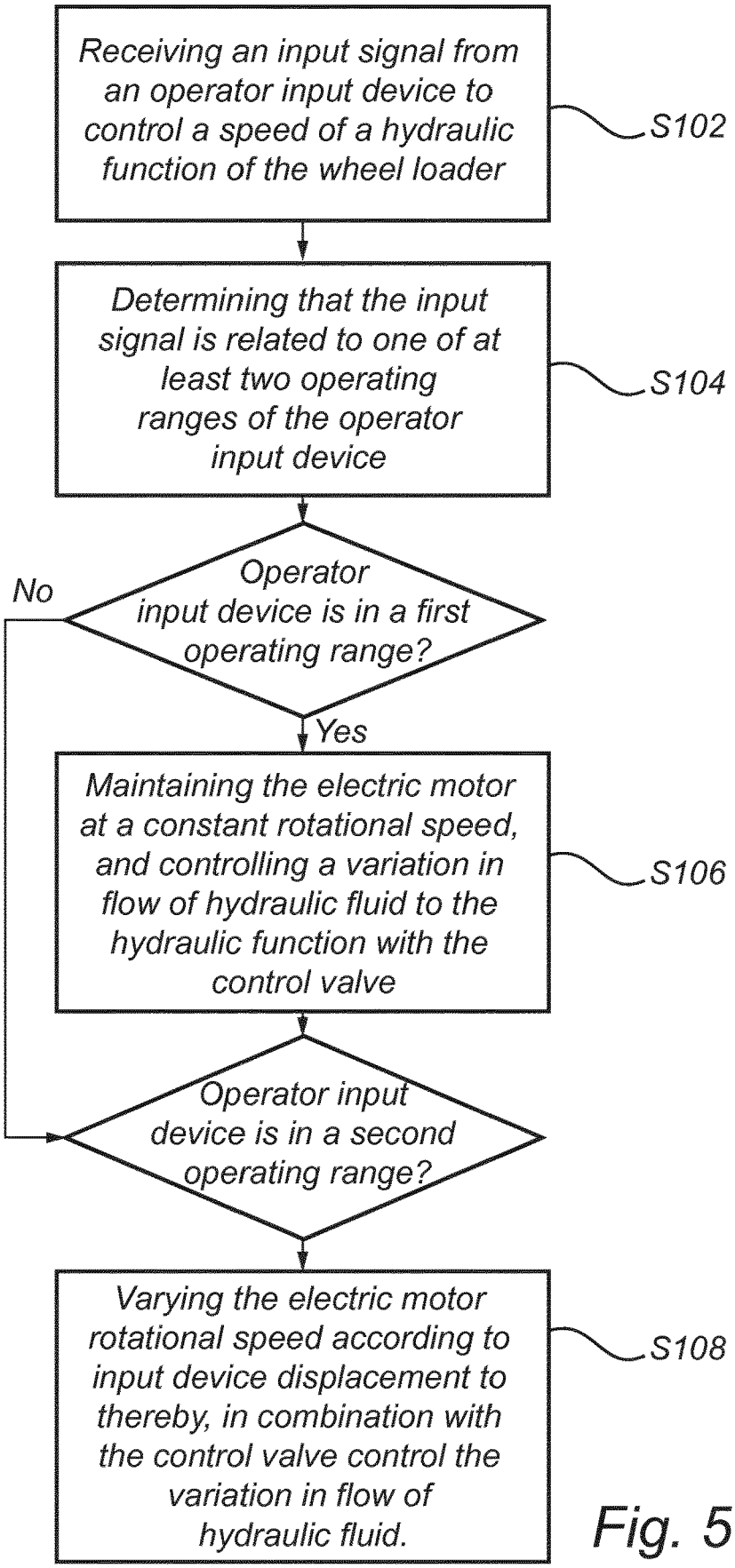
FIG. 5 is a flow-chart of method steps according to an embodiment of the invention.

FIG. 5 is a flow-chart of method steps according to an embodiment of the invention. The method steps are for controlling an electrically powered hydraulic system for a working machine. In step S102 is an input signal received from an operator input device to control a speed of a hydraulic function of the working machine. In step S104 it is determined that the input signal is related to one of at least two operating ranges of the operator input device. If it is determined that the operator input device is a first operating range, the electric motor speed is maintained (S106) at a constant rotational speed, and controlling a variation in flow of hydraulic fluid to the hydraulic function is performed with an electrically controlled control valve. If it is determined that the operator input device is a first operating range, then the electric motor rotational speed is varied (S108) according to input device displacement to thereby, in combination with the control valve control the variation in flow of hydraulic fluid to a hydraulic function.

The hydraulic fluid is preferably hydraulic oil.

The electronic control unit 11 may include a microprocessor, microcontroller, programmable digital signal processor or another programmable device. Thus, the electronic control unit comprises electronic circuits and connections (not shown) as well as processing circuitry (not shown) such that the electronic control unit can communicate with different parts of the working machine such as the brakes, suspension, driveline, in particular an electrical engine, an electric machine, a clutch, and a gearbox in order to at least partly operate the working machine. The electronic control unit may comprise modules in either hardware or software, or partially in hardware or software and communicate using known transmission buses such as CAN-bus and/or wireless communication capabilities. The processing circuitry may be a general purpose processor or a specific processor. The electronic control unit comprises a non-transitory memory for storing computer program code and data upon. Thus, the skilled addressee realizes that the electronic control unit may be embodied by many different constructions.

Although the figures may show a sequence the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art.

It is to be understood that the present invention is not limited to the embodiments described above and illustrated in the drawings; rather, the skilled person will recognize that many changes and modifications may be made within the scope of the appended claims. For example, although the present invention has mainly been described in relation to a wheel loader, the invention should be understood to be equally applicable for any type of working machine.

The invention claimed is:

1. An electrically powered hydraulic system for a working machine the electrically powered hydraulic system comprising:

a first electric motor to power a working hydraulic pump to operate at least one hydraulic function of the working machine, wherein a flow of hydraulic fluid generated by the hydraulic pump is controlled by an operation rotational speed of the electric motor, a second electric motor to power a drivetrain of the working machine, an electronically controlled control valve for controlling a flow of hydraulic fluid from the hydraulic pump to the at least one hydraulic function, wherein a flow of hydraulic fluid reaching the electronically controlled control valve is proportional to the flow of hydraulic fluid generated by the hydraulic pump in a first operating range and a second operating range, an operator input device for controlling the at least one hydraulic function, wherein the operator input device is operable in at least the first operating range and the second operating range, and an electronic control unit configured to:

when the operator input device is in the first operating range, maintain the operation rotational speed of the first electric motor at a constant operation rotational speed, and control a variation in the flow of hydraulic fluid to the at least one hydraulic function with the electronically controlled control valve, and when the operator input device is in the second operating range, control the variation in the flow of hydraulic fluid by varying the operation rotational speed of the first electric motor and by controlling the control valve, according to a displacement of the operator input device.

2. The electrically powered hydraulic system according to claim 1, wherein the operation rotational speed of the first electric motor is higher when the operator input device is in the second operating range, than the constant operation rotational speed of the first electric motor when the operator input device is in the first operating range.

3. The electrically powered hydraulic system according to claim 1, wherein the operator input device is configured to control an operation speed of a wheel loader attachment, or a wheel loader boom.

4. A wheel loader comprising the electrically powered hydraulic system according to claim 1.

5. The electrically powered hydraulic system according to claim 1, wherein the electronic control unit is configured to control the variation in the flow of hydraulic fluid to the at least one hydraulic function in the first operating range only with the electronically controlled control valve.

6. A method for controlling an electrically powered hydraulic system for a working machine, the system comprising a first electric motor to power a working hydraulic pump to operate at least one hydraulic function of the working machine, wherein a flow of hydraulic fluid generated by the hydraulic pump is controlled by an operation rotational speed of the first electric motor, a second electric motor to power a drivetrain of the working machine, and an electronically controlled control valve for controlling a flow of hydraulic fluid from the hydraulic pump to the at least one hydraulic function, wherein a flow of hydraulic fluid reaching the electronically controlled control valve is proportional to the flow of hydraulic fluid generated by the hydraulic pump in a first operating range and a second operating range of the operator input device, the method comprising:

receiving an input signal from an operator input device to control a speed of the at least one hydraulic function of the working machine, determining that the input signal is related to one of the first operating range and the second operating range of the operator input device, wherein, when the operator input device is determined to be in the first operating range, maintaining the operation rotational speed of the first electric motor at a constant operation rotational speed, and controlling a variation in the flow of hydraulic fluid to the hydraulic function with the control valve, and when the operator input device is determined to be in the second operating range, varying the operation rotational speed of the first electric motor according to an input device displacement to thereby, in combination with the control valve, control the variation in the flow of hydraulic fluid.

7. The method according to claim 6, wherein when the operator input device is determined to be in the second operating range, varying the operation rotational speed of the first electric motor proportional to the input device displacement.

8. The method according to claim 6, wherein the operation rotational speed of the first electric motor when the operator input device is in the second operating range is higher than the constant operation rotational speed of the first electric motor when the operator input device is in the first operating range.

9. A computer program comprising program code for performing the method of claim 6 when said program is run on a computer.

10. A computer readable medium carrying a computer program comprising program code for performing the method of claim 6 when said program is run on a computer.

11. A control unit for controlling the electrically powered hydraulic system for the working machine, the control unit being configured to perform the method according to claim 6.

* * * * *